US010587080B2

(12) United States Patent
Wang et al.

(10) Patent No.: US 10,587,080 B2
(45) Date of Patent: Mar. 10, 2020

(54) CONNECTOR, CONNECTOR ASSEMBLY AND LIGHTING SYSTEM

(71) Applicant: Current Lighting Solutions, LLC, East Cleveland, OH (US)

(72) Inventors: Xin Wang, Shanghai (CN); Brian Morgan Spahnie, Brunswick, OH (US)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/295,209

(22) Filed: Mar. 7, 2019

(65) Prior Publication Data

US 2019/0326712 A1 Oct. 24, 2019

(51) Int. Cl.

| | |
|---|---|
| ***H01R 33/00*** | (2006.01) |
| ***H01R 13/73*** | (2006.01) |
| ***H01R 13/52*** | (2006.01) |
| ***H01R 13/58*** | (2006.01) |
| ***F21V 23/06*** | (2006.01) |
| ***F21V 21/005*** | (2006.01) |
| *F21Y 115/10* | (2016.01) |
| *H01R 13/639* | (2006.01) |
| *F21Y 103/00* | (2016.01) |

(52) U.S. Cl.

CPC ..... *H01R 13/73* (2013.01); *F21V 21/005* (2013.01); *F21V 23/06* (2013.01); *H01R 13/5202* (2013.01); *H01R 13/5205* (2013.01); *H01R 13/5216* (2013.01); *H01R 13/5816* (2013.01); *F21Y 2103/00* (2013.01); *F21Y 2115/10* (2016.08); *H01R 13/639* (2013.01)

(58) Field of Classification Search

CPC ..... F21V 21/005; F21V 23/06; F21Y 2103/00–20; H01R 13/58–5845; H01R 13/62–6397; H01R 13/73–13/748

USPC ..... 362/217.13, 217.17, 645–659

See application file for complete search history.

(56) References Cited

U.S. PATENT DOCUMENTS

| | | | |
|---|---|---|---|
| 2014/0071668 | A1 | 3/2014 | Ai |
| 2015/0364853 | A1 | 12/2015 | Thijssen |

FOREIGN PATENT DOCUMENTS

| | | | |
|---|---|---|---|
| CN | 201314487 | Y | 9/2009 |
| CN | 202056571 | U | 11/2011 |

OTHER PUBLICATIONS

New Al Wave LED tube coming soon from AquaIllumination.

*Primary Examiner* — Jason M Han

(74) *Attorney, Agent, or Firm* — Buckley, Maschoff & Talwalkar LLC

(57) ABSTRACT

A connector is provided to be assembled on a first illumination element and configured to be releasably coupled to a mating connector on a second illumination element. The connector includes a connection element comprising a conductor. The conductor comprises a first end coupled to a cable extending through the connection element, and a second end is releasably connected to an end of a mating conductor of the mating connector. A mounting member is configured to secure the connection element to the first illumination element, and a first gap is defined between an internal surface of the mounting member and the external surface of the connection element. A first sealing element is coupled to the mounting member and the connection element; and a second sealing element is coupled to the mounting member and the cable.

13 Claims, 7 Drawing Sheets

CONNECTOR, CONNECTOR ASSEMBLY AND LIGHTING SYSTEM

BACKGROUND

Embodiments of the present disclosure relate generally to a connector assembly, and more particularly relate to a connector assembly for use in lighting field.

Connector assemblies comprising at least one connector are widely used in a multitude of fields. In the lighting field, connectors are used to connect illumination elements or used to connect illumination elements to a power source. Sometimes huge stress between connectors will cause failures like overheat, overload, burnout at the connectors and poor contacts between conductors of the connectors. Typically, the huge stress between connectors is caused by the thermal expansion & contraction of the illumination elements and/or difficult to align the illumination elements in a straight line by mounting clips.

In current approaches, the illumination elements are connected using cable to board connector assemblies or cable to cable connector assemblies which can avoid the stress between connectors. However, the connector assemblies with cables may need more space between connectors, and the cables may be exposed and thus look not neat.

Therefore, it is desirable to provide a connector assembly to address one or more of the above-mentioned situations.

BRIEF DESCRIPTION

In accordance with one embodiment disclosed herein, a connector is provided to be assembled on a first illumination element and to be releasably coupled to a mating connector on a second illumination element. The connector includes a connection element comprising a conductor, the conductor including a first end coupled to a cable extending through the connection element, and a second end releasably connected to an end of a mating conductor of the mating connector; a mounting member configured to secure the connection element to the first illumination element, wherein, a first gap is defined between an internal surface of the mounting member and the external surface of the connection element; a first sealing element coupled to the mounting member and the connection element, and configured to seal the first gap around a first longitudinal end of the mounting member; a second sealing element coupled to the mounting member and the cable, and configured to seal a second gap between a second longitudinal end of the mounting member and the cable; and wherein an inner cavity is formed among the mounting member, the connection element, the first sealing element and the second sealing element, and at least a part of the cable is accommodated in the inner cavity.

In accordance with another embodiment disclosed herein, a connector assembly includes a connector configured to be assembled on a first illumination element and a mating connector configured to be assembled on a second illumination and to be releasably coupled to the connector. The connector includes a connection element including a conductor, the conductor comprising a first end coupled to a cable extending through the connection element, and a second end releasably connected to an end of a mating conductor of the mating connector; a mounting member configured to secure the connection element to the first illumination element, a first gap is defined between an internal surface of the mounting member and the external surface of the connection element; a first sealing element coupled to the mounting member and the connection element, and configured to seal the first gap around a first longitudinal end of the mounting member; a second sealing element coupled to the mounting member and the cable, and configured to seal a second gap between a second longitudinal end of the mounting member and the cable; and an inner cavity is formed among the mounting member, the connection element, the first sealing element and the second sealing element, and at least a part of the cable is accommodated in the inner cavity. The mating connector includes a mating connection element having the mating conductor accommodated therein; and a mating mounting member coupled between the second illumination element and the mating connection element and configured to secure the mating connection element to the second illumination element.

In accordance with another embodiment, a lighting system includes at least two illumination elements, and at least one longitudinal end of the illumination element is coupled with a connector for engaging a mating connector on a power source or another illumination element. The connector includes a connection element including a conductor, the conductor comprising a first end coupled to a cable extending through the connection element, and a second end releasably connected to an end of a mating conductor of the mating connector; a mounting member configured to secure the connection element to the first illumination element, wherein, a first gap is defined between an internal surface of the mounting member and the external surface of the connection element; a first sealing element coupled to the mounting member and the connection element, and configured to seal the first gap around a first longitudinal end of the mounting member; a second sealing element coupled to the mounting member and the cable, and configured to seal a second gap between a second longitudinal end of the mounting member and the cable; and an inner cavity is formed among the mounting member, the connection element, the first sealing element and the second sealing element, and at least a part of the cable is accommodated in the inner cavity.

BRIEF DESCRIPTION OF THE DRAWINGS

The accompanying drawings, which are incorporated herein and form part of the specification, illustrate the present disclosure and, together with the description, further serves to explain the principles of the disclosure and to enable a person skilled in the relevant art(s) to make and use the disclosure.

DETAILED DESCRIPTION

Unless defined otherwise, technical and scientific terms used herein have the same meaning as is commonly understood by one of ordinary skill in the art to which this disclosure belongs. The terms "first", "second", and the like, as used herein do not denote any order, quantity, or importance, but rather are used to distinguish one element from another. Also, the terms "a", and "an" do not denote a limitation of quantity, but rather denote the presence of at least one of the referenced items. The use of "including," "comprising" or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect. The terms "component", "module", "system", "interface", or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer.

Figure 1:
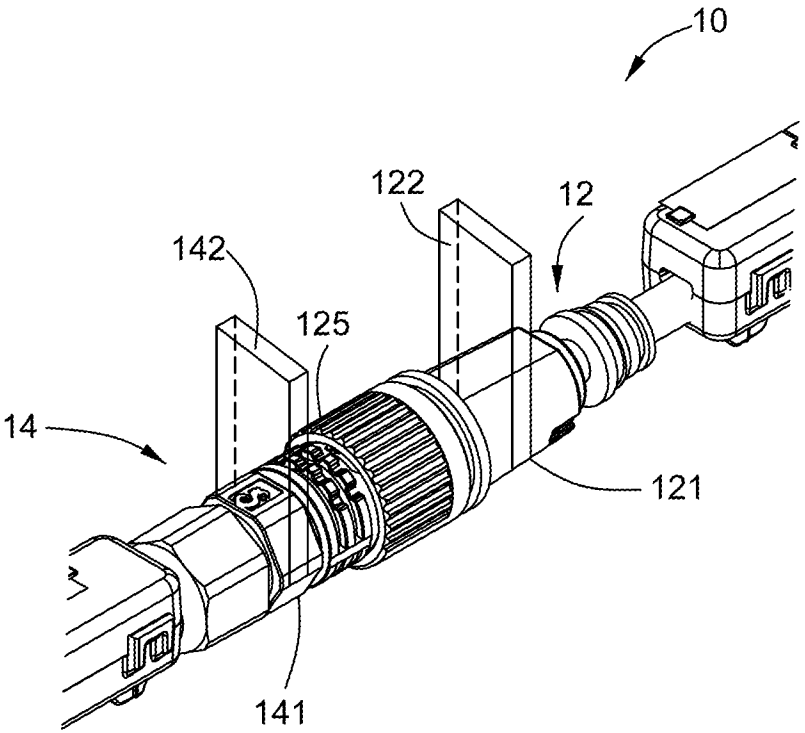
FIG. 1 is a perspective view of a connector assembly in accordance with aspects described herein.
Figure 2:
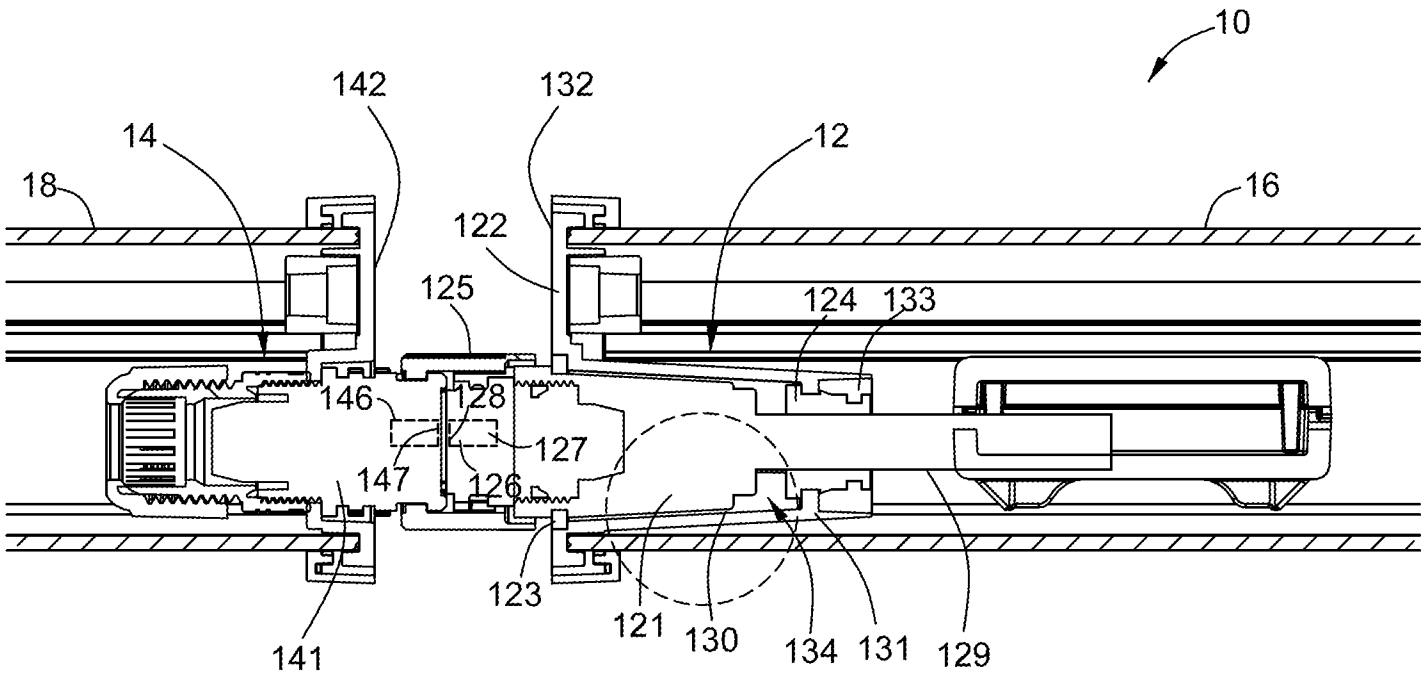
FIG. 2 is a cross-sectional view of the connector assembly of FIG. 1 in connecting with a first and second illumination element, in accordance with aspects described herein.

FIG. 1 is a perspective view of a connector assembly 10. FIG. 2 is a cross-sectional view of the connector assembly 10 of FIG. 1, in connecting with a first illumination element 16 and a second illumination element 18. The connector assembly 10 includes a connector 12 and a mating connector 14. The connector 12 on the first illumination element 16 is configured to be releasably coupled to the mating connector 14 on the second illumination element 18. The connector 12 includes a connection element 121, a mounting member 122, a first sealing element 123 and a second sealing element 124.

Figure 4:
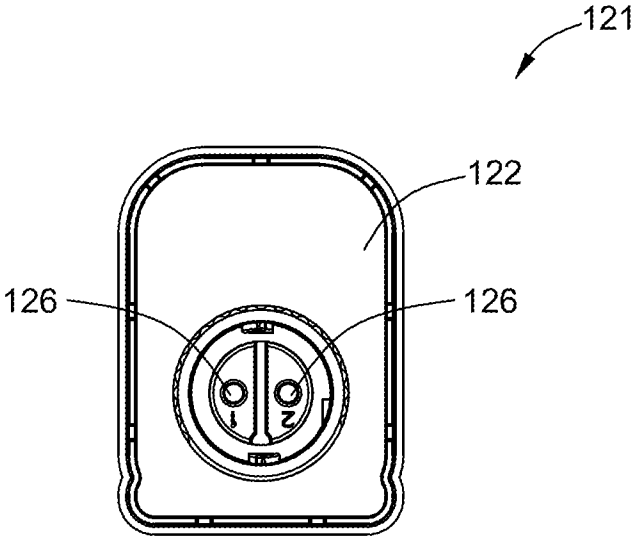
FIG. 4 is an end view of a connector for using in the connector assembly of FIG. 1 in accordance with aspects described herein.

As shown in FIG. 2, the connection element 121 includes a conductor 126, the conductor 126 includes a first end 127 coupled and electrically connected to a cable 129 extending through the connection element 121, and a second end 128 releasably connected to an end 147 of a mating conductor 146 of the mating connector 14. The cable 129 is located inside the first illumination elements 16. In the embodiment of FIG. 4, the connection element 121 includes two conductors 126. The number of the conductor 126 is not limited herein, and in some embodiments, the number may be greater than 2, such as 3, 4, 5 etc.

Figure 3:
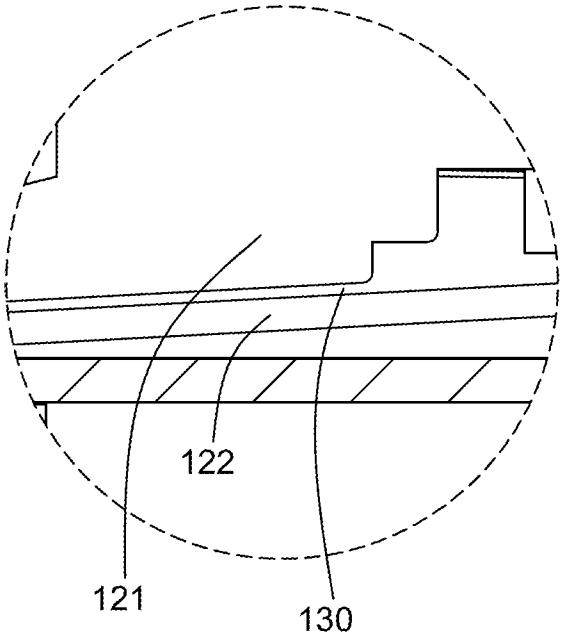
FIG. 3 is a partial enlarged view of the portion encircled in FIG. 2, showing a gap between a connector and a mounting member.

The mounting member 122 is configured to secure the connection element 121 to the first illumination element 16, further refer to FIG. 3, wherein, a first gap 130 is defined between an internal surface of the mounting member 122 and an external surface of the connection element 121. In some embodiments, the first gap 130 is from about 0.5 millimeters to about 10 millimeters in a radial direction. In some specific embodiments, the gap 130 is from about 0.5 millimeters to about 1 millimeter in a radial direction.

In some embodiments, the mounting member 122 includes a substantially hollow cylinder 131 and a securing element 132 coupled to one longitudinal end of the substantially hollow cylinder 131. The other end of the substantially hollow cylinder 131 is accommodated in the first illumination element 16. The external diameter of the substantially hollow cylinder 131 is determined based on the design of the first illumination element 16. The securing element 132 is configured to couple and fix the connection element 121 to the first illumination element 16. In some embodiments, the substantially hollow cylinder 131 and the securing element 132 is formed integrally. In some embodiments, the mounting member 122 is an endcap coupled on the first illumination element 16.

In the embodiment of FIG. 2, the connection element 121 has a substantially cylindrical structure, and the first gap 130 is defined between the internal surface of the mounting member 122 and the external surface of the substantially cylindrical structure of the connection element 121.

The first sealing element 123 is coupled to the mounting member 122 and the connection element 121, and configured to seal the first gap 130 around a first longitudinal end of the mounting member 122. As the connector assembly 10 may be used in outdoor light systems, the first sealing element 123 can prevent rain or other contaminants from entering the connector 12 and/or the first illumination element 16. In some embodiments, the first sealing element 123 is coupled to the securing element 132 and the connection element 121. In some embodiments, the first sealing element 123 is made of a material selected from silicone and rubber. An elastic material such as silicone and rubber material can not only seal the first gap 130, but also allow the connection element 121 slightly movable inside the mounting member 122. Thus, the connector element 121 is floatably connected with the mounting member 122 and the first illumination element 16. In some embodiments, the first sealing element 123 is a silicon gasket.

The second sealing element 124 coupled to the mounting member 122 and the cable 129 is configured to seal a second gap between a second longitudinal end of the mounting member 122 and the cable 129, and thereby can prevent contaminants from entering the first illumination element 16. In some embodiments, the second sealing element 124 is coupled to the substantially hollow cylinder 131 of the mounting member 122 and the cable 129. In some embodiments, the second sealing element 123 is made of strain relief materials, such as polyvinyl chloride materials or other plastic with similar characteristics.

In some embodiments, the annular second sealing element 124 is cured on the cable 129 via over moulding, and is coupled to the mounting member 122 via interference fit. In order to enhance a sealing performance, a glue layer 133 is provided between the second sealing element 124 and the mounting member 122, and a thickness of the glue layer 133 is about 1 to 8 millimeters. In a specific embodiment, the thickness of the glue layer 133 is about 1 to 3 millimeters.

An inner cavity 134 is formed among the mounting member 122, the connection element 121, the first sealing element 123 and the second sealing element 124, and at least a part of the cable 129 is accommodated in the inner cavity 134. As the cable 129 is made of a soft and elastic material with extensibility, when the connection element 121 slightly moves inside the mounting member 122, the cable 129 may not be pulled. Moreover, the second sealing element 124 may be configured to relief or absorb strains caused by the movement of the connection element 121 connected with the cable 129. In some embodiments, the movement includes a float along a direction perpendicular to a longitudinal direction of the connection element 121 and a rotation about ±20 degrees relative to the first illumination element 16.

Such a combination of the gap 130, the first sealing element 123 and the second sealing element 124 can remove a huge stress between the connector 12 and the mating connector 14 of the connector assembly 10 caused by the thermal expansion & contraction of the illumination elements and/or difficult to align the illumination elements in a straight line by mounting clips (not shown). Without the huge stress, failure risks of the connector assembly 10, such as overheat, overload, burnout at the connectors and poor contacts between conductors, can be minimized.

In some embodiments, the connector 12 further includes a coupler 125 secured to the connection element 121 and configured to be releasably coupled to of the mating connector 14.

Figure 5:
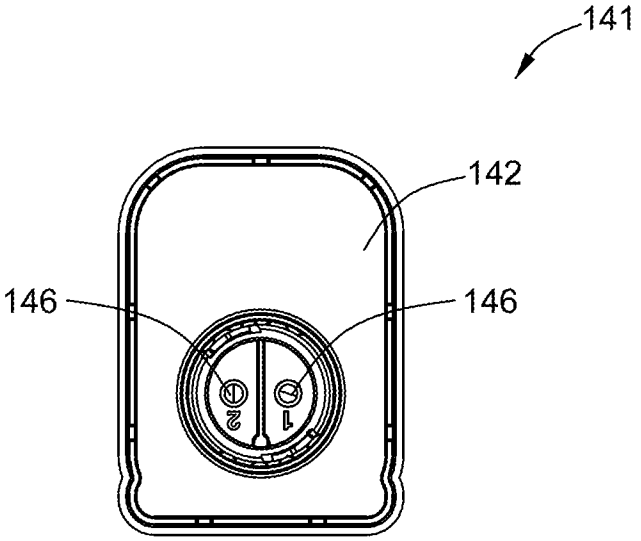
FIG. 5 is an end view of a mating connector for using in the connector assembly of FIG. 1 in accordance with aspects described herein.

The mating connector 14 includes a mating connection element 141 and a mating mounting member 142. The mating conductor 146 is provided in the mating connection element 141 and is electrically connected with the conductor 126 of the connection element 121. In the embodiment of FIG. 5, the mating connection element 141 includes two mating conductors 146. The number of the mating conductor 146 is not limited herein, and it depends on the number of the conductor 126. In some embodiments, the conductors 126 and/or the mating conductors 146 have an anti-rust layer such as a gold plating layer. The mating mounting member 142 is coupled between the second illumination element 18 and the mating connection element 141 and configured to secure the mating connection element 141 to the second illumination element 18.

Figure 6:
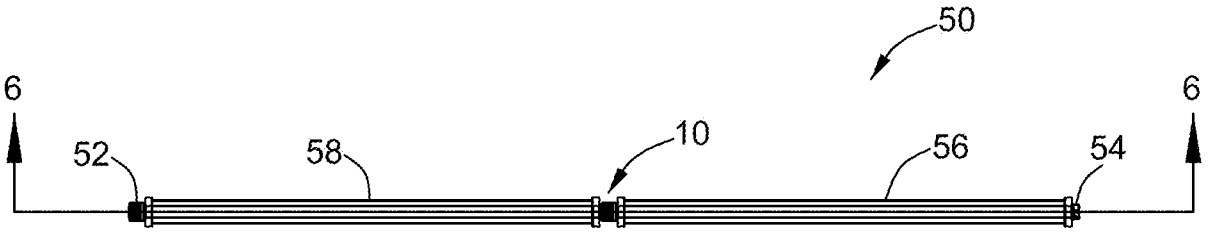
FIG. 6 is a front view of a lighting system using the connector assembly of FIG. 1 in accordance with aspects described herein.
Figure 7:
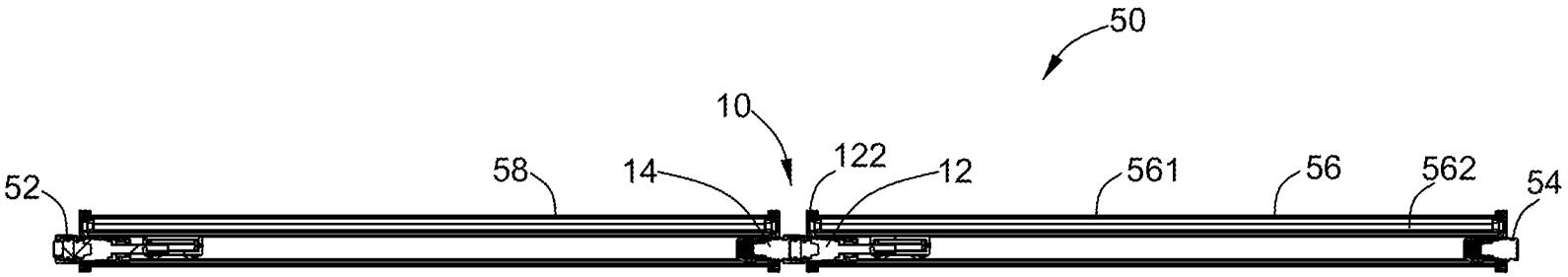
FIG. 7 is a cross-section view taken along the line 6-6 of FIG. 6.

FIG. 6 is a front view of a lighting system 50 using the connector assembly 10 of FIG. 1. FIG. 7 is a cross-section view taken along the line 6-6 of FIG. 6. Besides the connector assembly 10, the lighting system 50 further includes an illumination element 56 and an illumination element 58 connected by the connector assembly 10, a connector 52 on the illumination element 58 for engaging a mating connector on a power source or another illumination element (not shown) and a connector 54 on the illumination element 56 for engaging a mating connector on a power source or a yet another illumination element (not shown). In this embodiment, one end of the illumination element 56 is coupled with the connector 12 of the connector assembly 10, and the other end of the illumination element 56 is coupled with the connector 54. One end of the illumination element 58 is coupled with the mating connector 14 of the connector assembly 10, and the other end of the illumination element 58 is coupled with the connector 52. The connector 52 has a similar structure and function as the connector 12, and the connector 54 has a similar structure and function as the mating connector 14.

In some embodiments, the connector assembly 10 can be used in the lighting system with elongate illumination elements, such as battens, light tubes or light bars. The length of the elongate illumination elements is from about 2 feet to about 8 feet, such as 2 feet, 4 feet and 8 feet. In some specific embodiments, the length of the elongate illumination elements is from about 4 feet to about 8 feet, as the stress between the connector and the mating connector tends to occur in the long illumination elements. As shown in FIG. 7, the lighting system 50 includes elongate illumination elements 56, 58 which are connected via the connector assembly 10. The illumination elements will be described hereinafter in details by taking the illumination element 56 as an example. The illumination element 56 may include at least one light source board 562 for supporting and powering at least one light-emitting diode (LED) and a transparent or translucent housing 561 allowing a light from the LEDs emitted in a direction of 180°. The light source board 562 is coupled to the mounting member 122 to achieve an approximate same length as the illumination element 56. In some embodiments, the illumination element includes two light source boards positioned symmetrical relative to a vertical axis of illumination element to allow the LEDs to provide a 360° lighting.

A lighting system may comprise at least two illumination elements, at least one longitudinal end of the illumination element coupled with a connector for engaging a mating connector on a power source or another illumination element. Each set of two illumination elements may be connected by a connector assembly such as the connector assembly 10 as discussed above. In some embodiments, two opposite longitudinal ends of the illumination element are coupled with the connector and the mating connector, respectfully. In some embodiments, two opposite longitudinal ends of the illumination element are coupled with two connectors or two mating connectors.

While embodiments of the disclosure have been described herein, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

Furthermore, the skilled artisan will recognize the interchangeability of various features from different embodiments. The various features described, as well as other known equivalents for each feature, can be mixed and matched by one of ordinary skill in this art to construct additional systems and techniques in accordance with principles of this disclosure.

The invention claimed is:

1. A connector configured to be assembled on a first illumination element and to be releasably coupled to a mating connector on a second illumination element, the connector comprising:

a connection element comprising a conductor, the conductor comprising a first end coupled to a cable extending through the connection element, and a second end releasably connected to an end of a mating conductor of the mating connector;

a mounting member configured to secure the connection element to the first illumination element, wherein, a first gap is defined between an internal surface of the mounting member and the external surface of the connection element;

a first sealing element coupled to the mounting member and the connection element, and configured to seal the first gap around a first longitudinal end of the mounting member;

a second sealing element coupled to the mounting member and the cable, and configured to seal a second gap between a second longitudinal end of the mounting member and the cable; and wherein an inner cavity is formed among the mounting member, the connection element, the first sealing element and the second sealing element, and at least a part of the cable is accommodated in the inner cavity.

2. The connector according to claim 1, further comprising a coupler secured to the connection element and configured to be releasably coupled to a mating connection element of the mating connector.

3. The connector according to claim 1, wherein the first gap between the internal surface of the mounting member and the external surface of the connection element is from about 0.5 millimeters to about 10 millimeters in a radial direction.

4. The connector according to claim 1, wherein the connector element is floatably connected with the first illumination element.

5. The connector according to claim 4, wherein the connector is enabled to rotate about ±20 degree relative to the first illumination element.

6. The connector according to claim 1, wherein the first sealing element is made of a material selected from silicone and rubber.

7. The connector according to claim 1, wherein the mounting member comprises a substantially hollow cylinder and a securing element coupled to one end of the substantially hollow cylinder, and the securing element is configured to fix the connection element to the first illumination element.

8. The connector according to claim 7, wherein the first sealing element is coupled to the securing element and the connection element, and the second sealing element is coupled to the substantially hollow cylinder and the cable.

9. The connector according to claim 1, wherein the second sealing element is cured on the cable and is coupled to the mounting member via interference fit.

10. The connector according to claim 1, further comprising a glue layer between the second sealing element and the mounting member.

11. A connector assembly comprising a first connector configured to be assembled on a first illumination element and a mating connector configured to be assembled on a second illumination element and to be releasably coupled to the first connector, wherein, the first connector comprises:

a connection element comprising a conductor, the conductor comprising a first end coupled to a cable extending through the connection element, and a second end releasably connected to an end of a mating conductor of the mating connector;

a mounting member configured to secure the connection element to the first illumination element, wherein, a first gap is defined between an internal surface of the mounting member and the external surface of the connection element;

a first sealing element coupled to the mounting member and the connection element, and configured to seal the first gap around a first longitudinal end of the mounting member;

a second sealing element coupled to the mounting member and the cable, and configured to seal a second gap between a second longitudinal end of the mounting member and the cable; and wherein an inner cavity is formed among the mounting member, the connection element, the first sealing element and the second sealing element, and at least a part of the cable is accommodated in the inner cavity; and the mating connector comprises:

a mating connection element having the mating conductor accommodated therein; and a mating mounting member coupled between the second illumination element and the mating connection element and configured to secure the mating connection element to the second illumination element.

12. A lighting system comprising at least two illumination elements, at least one longitudinal end of the illumination element coupled with a first connector for engaging a mating connector on a power source or another illumination element, wherein the first connector comprises:

a connection element comprising a conductor, the conductor comprising a first end coupled to a cable extending through the connection element, and a second end releasably connected to an end of a mating conductor of the mating connector;

a mounting member configured to secure the connection element to the illumination element, wherein, a first gap is defined between an internal surface of the mounting member and the external surface of the connection element;

a first sealing element coupled to the mounting member and the connection element, and configured to seal the first gap around a first longitudinal end of the mounting member;

a second sealing element coupled to the mounting member and the cable, and configured to seal a second gap between a second longitudinal end of the mounting member and the cable; and wherein an inner cavity is formed among the mounting member, the connection element, the first sealing element and the second sealing element, and at least a part of the cable is accommodated in the inner cavity.

13. The lighting system according to claim 12, wherein the illumination element is a batten or a light tube, and the length of the illumination element is from about 2 feet to about 8 feet.

* * * * *